United States Patent [19]

Haydon

[11] Patent Number: 4,799,283

[45] Date of Patent: Jan. 24, 1989

[54] COLLAPSIBLE CLEANING IMPLEMENT

[75] Inventor: Susen J. Haydon, London, England

[73] Assignee: Interpat Ltd., London, England

[21] Appl. No.: 118,183

[22] Filed: Nov. 6, 1987

[30] Foreign Application Priority Data

Nov. 8, 1986 [DE] Fed. Rep. of Germany ..... 3638225

[51] Int. Cl.[4] ..... A47L 13/11

[52] U.S. Cl. ..... 15/229.1; 15/228; 15/147 R

[58] Field of Search ..... 15/119 R, 147 R, 228, 15/229.1, 229.2, 229.6, 231, 116.1, 116.2, 362, 119 A

[56] References Cited

U.S. PATENT DOCUMENTS

| | | | |
|---|---|---|---|
| 2,893,033 | 7/1959 | Vosbikian et al. | 15/119 A |
| 2,926,373 | 3/1960 | Knapp | 15/119 A |
| 2,947,014 | 8/1960 | O'Conner et al. | 15/119 A |
| 2,967,317 | 1/1961 | Richards | 15/119 A |
| 4,468,830 | 9/1984 | Batchelor | 15/119 A |

FOREIGN PATENT DOCUMENTS

| | | | |
|---|---|---|---|
| 267816 | 12/1964 | Australia | 15/119 A |

*Primary Examiner*—Timothy F. Simone
*Assistant Examiner*—J. Dwight Poffenberger, Jr.
*Attorney, Agent, or Firm*—Peter K. Kontler

[57] ABSTRACT

A mop wherein the mop head has two mirror symmetrical plate-like sections which are attached with play to a support at one end of a mop handle by hinges each of which enables the respective section to move toward or away from the other section while the sections confront each other in collapsed position of the mop head. This renders it possible to expel moisture from cushions at the undersides of the sections. The sections are pivotable to and can be releasably held and propped in extended positions in which they are substantially or exactly coplanar and the cushions at their undersides are ready to sweep the floor.

16 Claims, 3 Drawing Sheets

COLLAPSIBLE CLEANING IMPLEMENT

BACKGROUND OF THE INVENTION

The invention relates to cleaning implements in general, and more particularly to improvements in mops and similar hand-held cleaning implements wherein a mop head is mounted at one end of a handle and carries strings and/or otherwise configurated sweeping portions which come in actual contact with the surface to be cleaned, dried, rubbed, coated, moistened and/or otherwise treated.

It is already known to provide the head of a mop with a detachable sweeping and/or wiping portion which can be separated from the mop head from time to time for the purpose of cleaning or replacement. A press or an analogous mop wringing device is used to expel impurities from the detached portion of the mop. It is further known to employ a composite mop head whose sections are movable relative to each other. The sweeping portion is secured to the marginal portions of the sections so that it can be partially detached preparatory to cleaning. Thus, when the sections of the mop head are held in their normal or operative positions, the sweeping portion is attached all the way along their marginal portions and constitutes or resembles a flat pad which is ready for use as a means for sweeping, wetting, drying and/or similarly treating a selected surface. In order to facilitate its cleaning, the sweeping portion or pad is partially detached from the sections of the mop head so that, when the sections are collapsed, the non-attached part of the sweeping portion forms a loop which extends from the collapsed sections and is ready to be relieved of accumulated impurities by immersing it in a body of water or another cleaning fluid or by introducing it into a suitable press forming part of a mop wringer.

A drawback of such conventional cleaning implements is that the sweeping portion must be touched by hands in order to separate it from the mop head, either entirely or in part. This is particularly undesirable when the sweeping portion has gathered aggressive solid and/or liquid substances which come in contact with and can cause injury or irritation to the skin. Moreover, and if the sweeping portion is to be detached while it dips, or is about to dip, into a bucket, the operator must bend in order to manipulate the sweeping portion at a level close to the floor. Repeated bending is tiresome, even to a young person, so that such types of cleaning implements have failed to gain widespread acceptance in the relevant industries. Similar problems are encountered when the partially or fully separated sweeping portion of the mop must be introduced into or removed from a press, i.e., the sweeping portion must be manipulated by hand and the hand of a clumsy, careless, unskilled or infirm operator is likely to be injured during introduction of the partly or fully detached sweeping portion into a mop wringer which employs a press.

OBJECTS AND SUMMARY OF THE INVENTION

An object of the invention is to provide a novel and improved mop-like cleaning implement which is constructed and assembled in such a way that the sweeping portion need not be touched by hand preparatory to or upon completion of a wringing or other treatment involving expulsion of accumulated impurities.

Another object of the invention is to provide a cleaning implement which can be manipulated while the person in charge remains in erected or upright position so that such manipulation is less tiresome than the manipulation of conventional cleaning implements.

A further object of the invention is to provide a novel and improved mop of the type wherein the mop head is assembled of several movably mounted sections.

An additional object of the invention is to provide a cleaning implement whose sweeping portion can be subjected to a thorough and intensive cleaning action in relatively simple wringers and analogous apparatus.

Still another object of the invention is to provide a mop which is compact and inexpensive, wherein the sweeping portion must be detached only when it requires replacement with a fresh or different sweeping portion, and which can be designed to employ any one of a variety of sweeping portions including strings, sponges and/or others.

A further object of the invention is to provide a novel and improved method of expelling impurities from sweeping portions on movably mounted sections of a mop head.

Another object of the invention is to provide a novel and improved connection between the head and other parts of a mop.

An additional object of the invention is to provide a collapsible cleaning implement which is constructed and assembled in such a way that the operator is required to use her or his hands only to touch the handle because all other manipulations can be carried out by way of the handle or, if necessary, by relying on a shoe, boot or other article of footwear which is worn by the operator of the implement.

The invention is embodied in a cleaning implement which resembles or constitutes a mop. The improved implement comprises a support, a composite mop head which includes substantially mirror symmetrical first and second wing-like sections, and first and second hinges which respectively connect the first and second sections to the support for pivotal movement about discrete parallel axes between extended positions in which the sections are or can be substantially coplanar, and collapsed or inoperative positions in which the sections are adjacent and confront each other. At least the first hinge is designed to mount the first section with limited freedom of movement substantially at right angles to the respective axis. The arrangement is preferably such that the first section has limited freedom of movement toward and away from the second section. In accordance with a presently preferred embodiment, the first section comprises a substantially plate-like member and the aforementioned freedom of movement is substantially at right angles to the plane of the plate-like member in the collapsed position of the first section.

The first hinge can comprise a substantially sleeve-like female component and a substantially pintle-like male component in the female component. One of the components (e.g., the male-component) is provided on the support, and the other component is provided on the first section. The male component is received in the female component with the aforementioned limited freedom of movement. The female component has a socket (such socket can constitute a through hole) for the male component, and the socket can have a substantially oval or elliptical cross-sectional outline. The width of the socket can approximate the diameter of the male component, and the length of the socket can exceed its width by the extent of the aforementioned freedom of movement.

The second hinge can also comprise male and female components, and the male component of the second hinge can be received in the respective female component with at least some freedom of movement at right angles to the respective axis so that the second section is movable toward and away from the first section in the collapsed positions of the sections.

The sections can resemble or constitute substantially square or rectangular plate-like members each of which has a marginal portion adjacent the support in each position of the respective section. The hinges are arranged to connect such marginal portions of the respective sections to the adjacent portions of the support. In accordance with a presently preferred embodiment, each hinge comprises two aligned portions which may but need not be identical, and the support can comprise an extension (e.g., in the form of a lug) between each pair of aligned portions, i.e., each such extension is flanked by the two portions of the respective hinge.

The sections have surfaces which may but need not be exactly flat and are adjacent each other in the collapsed positions of the sections. The implement further comprises deformable absorbent and/or sweeping cushions which are affixed to their surfaces. The means for preferably releasably securing the cushions to the surfaces of the respective sections can constitute an adhesive substance or connections of the type known as Velcro (trademark). The cushions can constitute integral parts of a one-piece deformable pad, and the support can be provided with a chamber which is located between the first and second hinges and receives a median portion of the one-piece pad (between the two cushions) when the sections are moved to their collapsed positions.

Detent means are provided for releasably holding the sections in their extended (operative) positions. The support has first surfaces and the sections have second surfaces each of which is adjacent one of the first surfaces in the extended position of the respective section. The detent means are preferably disposed at or close to the centers of the associated first and second surfaces.

The implement can further comprise blocking means serving to prevent stray movements of the support and the first section or both sections relative to each other in the extended positions of the sections. Such blocking means can be provided in addition to or it can include the aforementioned detent means. For example, the blocking means can include means for coupling each section to the support at two but preferably three or even more spaced-apart locations. In accordance with a presently preferred embodiment, the blocking means can include first and second stops provided on the support and abutting the respective sections in the extended positions of the sections. The sections can be provided with means for holding them against sliding and/or other stray movements relative to the support i.e., relative to the respective stops. Such holding means can include recesses which are provided in the aforementioned (second) surfaces of the sections and receive the corresponding stops, preferably in such a way that each stop is fully or nearly fully confined in and at least substantially fills the respective recess.

The novel features which are considered as characteristic of the invention are set forth in particular in the appended claims. The improved cleaning implement itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
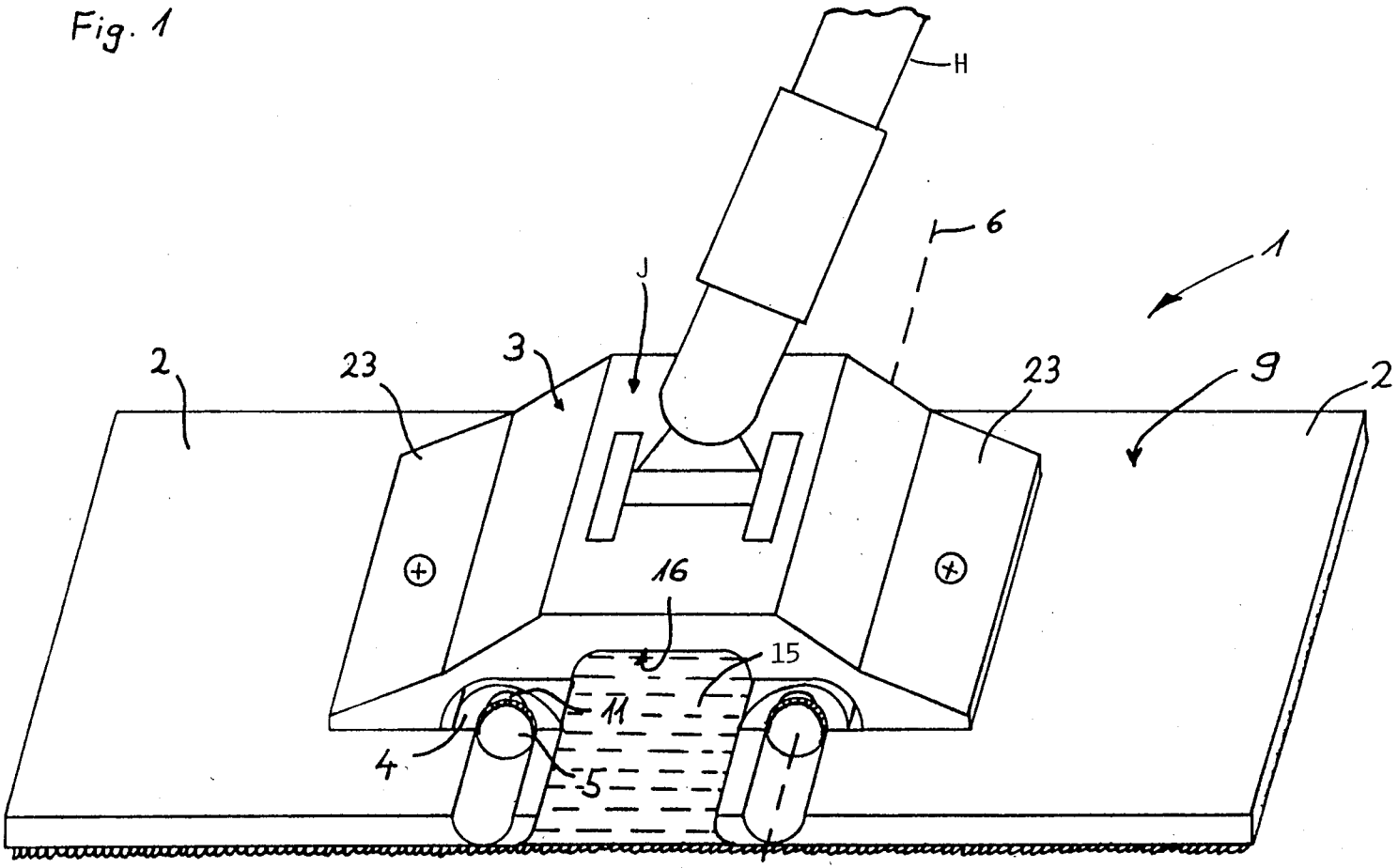
FIG. 1 is a perspective view of a mop-like collapsible cleaning implement which embodies the invention, a portion of the handle being broken away and the sections of the mop head being shown in extended positions.
Figure 2:
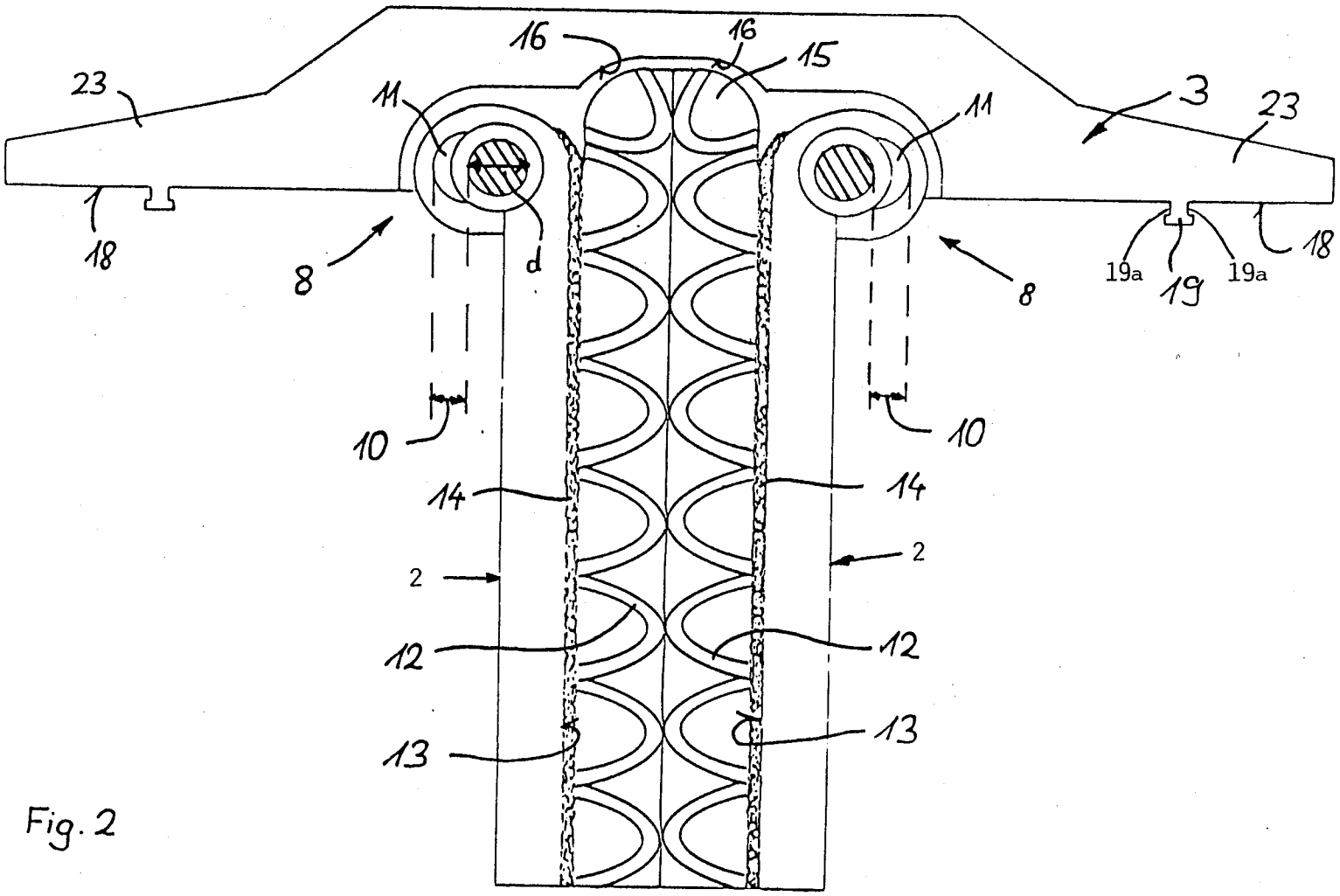
FIG. 2 is a front elevational view of the cleaning implement, with the handle omitted and with the sections of the mop head shown in collapsed positions.
Figure 3:
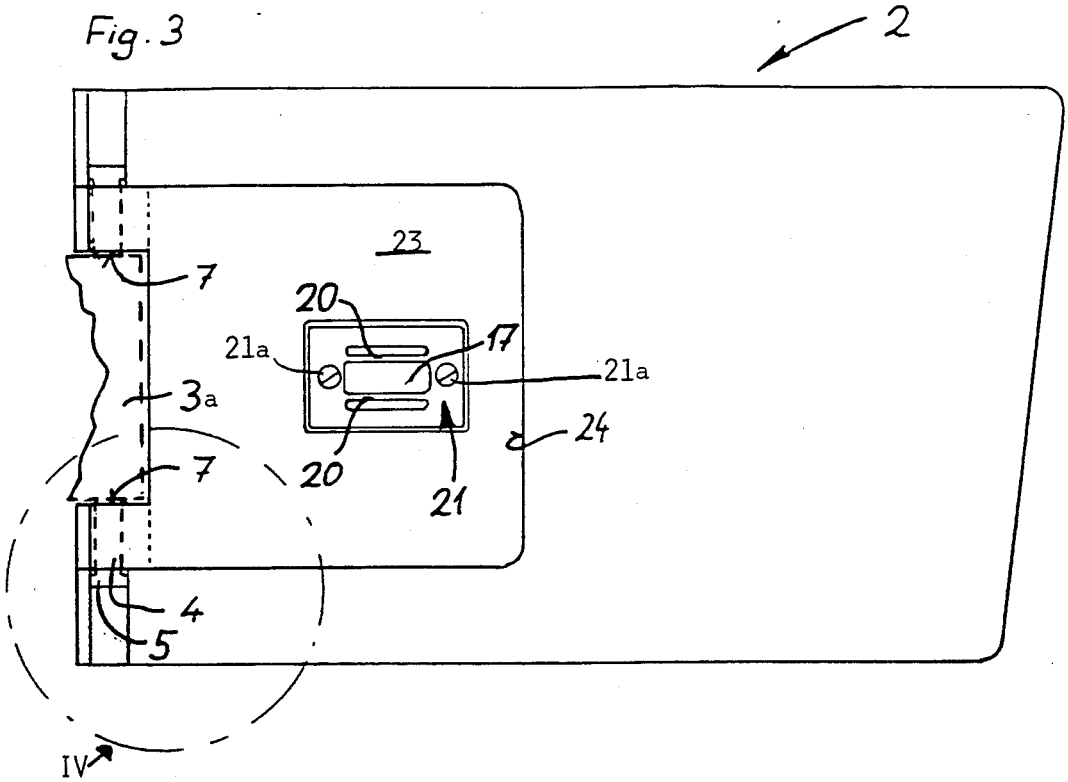
FIG. 3 is a plan view of one of the sections in extended position and further showing a portion of the support for the sections of the mop head.
Figure 4:
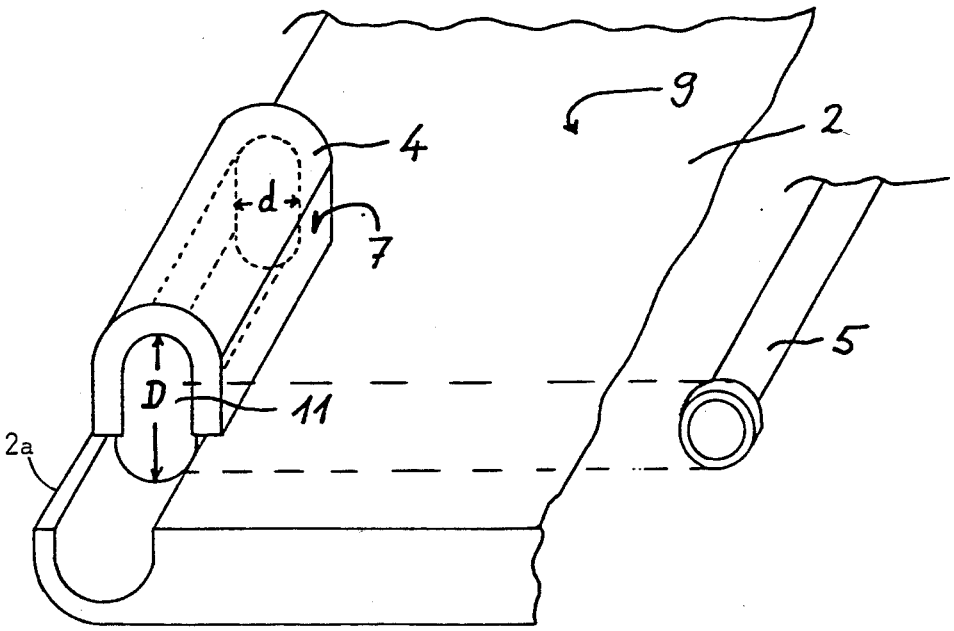
FIG. 4 is an enlarged exploded perspective view of a detail within the phantom-line circle IV in FIG. 3.

FIG. 1 shows a portion of a cleaning implement 1 which is a mop having a handle H one end portion is articulately connected to the central portion of a support 3 by a universal or other suitable joint J in a manner not forming part of the present invention. The mop head 9 of the implement 1 comprises two mirror symmetrical sections 2 each of which is a plate-like member having a substantially rectangular or square outline. FIG. 3 shows that the section 2 which is shown therein has a slightly trapezoidal outline. The sections 2 of the mop head 9 are pivotable relative to each other between the extended positions of FIG. 1 in which they are substantially coplanar, and the collapsed positions of FIG. 2 in which they are adjacent and confront each other. Such pivoting takes place about discrete parallel axes 6 defined by two hinges 8 each of which connects a substantially straight marginal portion 2*a* (FIG. 4) of the respective section 2 to the adjacent portion of the support 3. Those surfaces (14) of the sections 2 which are adjacent and substantially parallel to each other in the collapsed positions of the sections are provided with deformable cushions 12 of foam rubber or other suitable moisture and dirt gathering material, and each such cushion can be separably attached to the respective surface 14 by a coupling 13 of the type known as "Velcro" (trademark) or in any other suitable way so as to ensure that spent cushions can be replaced with fresh cushions without the need to discard the handle H, the support 3 and the mop head 9.

Each hinge 8 comprises a sleeve-like female component 4 (see particularly FIG. 4) which has a socket 11 in the form of a through hole with an oval cross-sectional outline, and a male component in the form of a pintle 5. The sleeves 4 are provided on the sections 2, and the pintles 5 are provided on the support 3. The width of the outline of each socket 11 equals d, and the length D of the outline of each socket equals d+10 wherein d is the diameter of a pintle, i.e., the pintles 5 are received in the respective sleeves 4 with a certain limited freedom (10) of movement in directions at right angles to the planes of the plate-like members which constitute the sections 2. In other words, when the sections 2 are moved to their collapsed positions which are shown in FIG. 2, they are movable toward and away from each other to thereby deform or permit expansion of the cushions 12. Such repeated squeezing and expansion in a body of water or another cleaning fluid results in rapid and reliable expulsion of gathered impurities. All that is necessary is to introduce the sections 2 into a press wherein they can be moved toward and away from each other while dipping into a body of water or another fluid so that the cushions 12 and/or the sections 2 need not be touched by hand during any stage of treatment of the cushions.

For example, the cushions 12 can be relieved of a high percentage of accumulated impurities in a press wherein the sections 2 are repeatedly moved toward and away from each other to alternately squeeze and permit expansion of the cushions, and the thus treated cushions are thereupon inserted into a bucket of water to be rinsed in response to repeated movement of sections 2 toward and away from each other. The diameter of the bucket can be a relatively small fraction of the length of the mop head 9 in extended positions of its sections 2.

Each hinge 8 comprises two aligned portions 7 (see FIG. 3) which flank an extension 3*a* of the support 3. The pintles 5 of the two sections 7 of each hinge 8 are coaxial with each other and each thereof has a shank extending with the aforediscussed freedom (10) of movement into the respective sleeve 4 on the corresponding section 2.

FIGS. 1 and 2 show that the cushions 12 form part of a one-piece pad which further includes a median or intermediate portion 15. The portion 15 forms an outwardly bulging loop in response to movement of the sections 2 to their collapsed positions of FIG. 2, and the support 3 is formed with a chamber 16 which is disposed between the hinges 8 and confines the median portion 15 in the collapsed positions of the sections 2. The dimensions of the chamber 16 can be selected in such a way that it is practically filled by the median portion 15 of the one-piece pad when the sections 2 are held in the collapsed positions of FIG. 2. The median portion 15 is also compressed and allowed to expand in response to movement of the collapsed sections 2 toward and away from each other so that such median portion is relieved of impurities simultaneously with the cushions 12.

The implement 1 further comprises detent means for releasably holding the sections 2 in the extended positions of FIG. 1. Each detent means comprises a male detent element 19 at the center of the surface 18 of the corresponding half of the support 3 and a female detent element 21 at the center of that surface of the section 2 which overlies the surface 18 in the extended position of the section 2. Each female detent element 21 has a window 17 flanked by elastically deformable strips 20 which enter the grooves 19*a* of the respective male detent element 17 in the extended position of the section 2 so that the latter is reliably held in the operative position in which the respective cushion 12 is ready to be used as a means for sweeping the surface of a floor or any other surface which can or should be cleaned with a mop. The female detent elements 21 are separably secured to the respective sections 2 by screws 21*a* or in another suitable way so that they can be replaced in response to destruction of or damage to or aging of the elastically deformable strips 20.

When the grooves 19*a* of the male detent elements 19 on the support 3 receive the strips 20 of the respective female detent elements 21, the sections 2 are held against wobbling and/or other stray movements relative to the support 3 and its surfaces 18. On the other hand, the sections 2 are movable toward and away from each other as soon as they are caused to assume the collapsed positions of FIG. 2 because the sockets 11 of their sleeves 4 are elongated at right angles to the planes of the respective sections so that the freedom of movement of the sections 2 toward and away from each other suffices to ensure a predictable and adequate compression of cushions 12 for the purposes of expelling impurities and/or rinsing.

In order to even further reduce the likelihood of stray movements of sections 2 relative to the support 3 and vice versa when the sections 2 are held in the extended positions of FIG. 1, the lateral portions 23 of the support 23 preferably constitute stops which extend into recesses 24 provided therefor in the respective surfaces of the sections 2. The female detent elements 21 are mounted in such recesses. Once the stops 23 enter the corresponding recesses 22 and the male detent elements 19 snap into the respective female detent elements 21, the sections 2 are reliably held in their extended positions without any wobbling. The stops 23 may but need not be fully confined in the respective recesses 24 in the extended positions of the sections 2. The depth of the recesses 24 can be in the range of one or more millimeters (e.g., between 1 and 5 mm). An advantage of stops 23 and recesses 24 is that the pintles 5 and the sleeves 4 need not take up any stresses while the sections 2 are held in the extended positions of FIG. 1.

The illustrated male and female detent elements 19, 21 can be replaced with other types of detent means without departing from the spirit of the invention. For example, the male detent elements 19 can be replaced with permanent magnets and the female detent elements 21 can be replaced with portions of ferromagnetic material to ensure that the sections 2 are reliably attracted to the respective stops 23 in the extended positions of FIG. 1. A push with a boot or another article of footwear should suffice to disengage the male and female detent elements and to thus enable the sections 2 to move toward their collapsed positions.

It is further clear that the stops 23 and recesses 24 can be replaced by other types of means for blocking stray movements of the sections 2 relative to the support 3 when the sections are caused to assume the extended positions of FIG. 1. For example, each stop 3 can be in a three-point contact with the adjacent surfaces of the sections 2 to thus ensure that, in cooperation with the detent means 19, 21 or analogous detent means, the sections 2 will be reliably held against any undesirable or excessive stray movements relative to the support 3 when the cleaning implement 1 is ready to perform its sweeping, moistening, drying and/or other function.

An important advantage of the improved cleaning implement 1 is that it can be manipulated by way of the handle H and, if necessary, by relying on an article of footwear so that the hands of the operator need not contact any of those parts which are used to sweep floors and are thus likely to gather substances which could be harmful to the skin. Moreover, the operator need not bend in order to introduce the sections 2 into a bucket or into a mop wringer. If and when the pad including the cushions 12 and the median portion 15 necessitates replacement, such operation can be carried out subsequent to a thorough cleaning of the mop head 9, support 3 and sections 2 (with pad 12, 15, 12 and attaching means 13) in a body of water or another cleaning fluid so that the danger of contact with harmful chemicals or other substances which could cause injury or discomfort is negligible or nil. An article of footwear can be used to disengage the female detent elements 21 from the male detent elements 19 as well as to pivot the sections 2 from the positions of FIG. 2 back to the positions of FIG. 1. Once the sections 2 are spread apart, their pivoting to the extended positions of FIG. 1 and reengagement of male and female detent elements 19, 21 can be completed by simply pushing the cushions 12 against the floor.

Another important advantage of the improved cleaning implement 1 is that the expulsion of impurities from the cushions 12 and median portion 15 of the pad can be completed within a short interval of time and that the implement is ready for renewed use as soon as the expelling step is completed. This is due to the fact that the pad need not be detached, even in part, from the sections 2 prior to expulsion of impurities and need not be reattached to the sections when the expelling step is completed. A mop wringer which can be used (perhaps with certain modifications) to expel impurities from the paid of the improved cleaning implement 1 is disclosed in commonly owned copending patent application Ser. No. 796,015 filed Nov. 7, 1985 by Dieter Sacks et al., now U.S. Pat. No. 4,704,763 granted 11/10, 1987. A somewhat different wringing apparatus is disclosed in commonly owned U.S. Pat. No. 4,663,798 granted May 12, 1987 to Dieter Sacks et al.

The one-piece pad including the cushions 12 and the median portion 15 will be replaced due to extensive wear after a prolonged period of use or if the operator wishes to carry out a different operation, for example, to employ a paid which is best suited to apply polish, to apply a solvent, to scrub a surface with a pronounced abrasive action or to use a pad having strings instead of a layer of foam rubber or the like. It is further clear that the one-piece pad can be replaced with two discrete cushions each of which is connectable to the surface 14 of the respective section 2. The one-piece pad is preferred at this time (even though the utilization of such one-piece pad necessitates the provision of the chamber 16) because it takes less time to detach a one-piece pad or to reattach a one-piece pad than if each of the sections 2 were to be separably connected with a discrete cushion. The dimensions of the chamber 16 are preferably selected in such a way that the median portion 15 of the paid is not unduly compressed and eventually destroyed in response to pivoting of the sections 2 to the collapsed positions of FIG. 2 but that the median portion 15 is also compelled to contract and expand in response to movement of collapsed sections 2 toward and away from each other to the extent permitted by the difference between the widths d and lengths D of the non-circular outlines of the sockets or holes 11 in the sleeves 4 of the sections 2.

A further important advantage of the improved cleaning implement 1 is that the aforediscussed blocking means ensures reliable retention of sections 2 in the extended positions of FIG. 1 as soon as the male detent elements 19 penetrate into the adjacent female detent elements 21, i.e., when the stops 23 of the support 3 enter the respective recesses 24. At such time, the sections 2 are held against any movement away from the surfaces 18 of the support 3, against any movement along the surfaces 18 as well as against any angular movement about axes which are normal to the axes 6 of the hinges 8 in spite of the fact that the pintles 5 of the hinges 8 are received in the respective sleeves 4 with a play which suffices to ensure adequate compression of cushions 12 when the operator is in the process of cleaning the cushions. Moreover, and as already mentioned above, the blocking means 19, 21, 23, 24 ensure that the hinges 8 need not take up any (or any appreciable) stresses when the sections 2 are held in the extended or operative positions of FIG. 1. The placing of detent elements 19, 21 at or close to the centers of neighboring surfaces of the stops 23 and sections 2 also contributes to more reliable retention of sections 2 in optimum positions with reference to the support 3 when the cleaning implement is ready for use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A cleaning implement, particularly a mop, comprising a support having first and second stops; a composite mop head including substantially mirror symmetrical first and second sections, said first section having freedom of movement toward and away from said second section; and first and second hinges respectively connecting said first and second sections to said support for pivotal movement about discrete axes between extended positions in which said sections are substantially coplanar and respectively abut said first and second stops, and collapsed positions in which said sections are adjacent and confront each other, said sections having means for holding said sections against movement relative to the respective stops in extended positions of said sections, said holding means including recesses for said stops in the respective sections and at least said first hinge mounting said first section with limited freedom of movement substantially at right angles to the respective axis.

2. The implement of claim 1, wherein said first section includes a plate-like member and said limited freedom of movement is substantially at right angles to the plane of said member in the collapsed position of said first section.

3. The implement of claim 1, wherein said first hinge comprises a substantially sleeve-like female component and a substantially pintle-like male component in said female component, one of said components being provided on said support and the other of said components being provided on said first section, said male component being received in said female component with said limited freedom of movement.

4. The implement of claim 3, wherein said second hinge also comprises male and female components and the male component of said second hinge is received in the respective female component with at least some freedom of movement so that said second section is movable within limits toward and away from said first section in the collapsed position of said second section.

5. The implement of claim 1, wherein said female component has a socket for said male component, said socket having a substantially oval cross-sectional outline.

6. The implement of claim 5, wherein said socket has a width approximating the diameter of said male component and a length exceeding said diameter by the extent of said freedom of movement.

7. The implement of claim 1, wherein said sections have marginal portions adjacent said support in each of said positions, each of said hinges being arranged to connect said support with the marginal portion of the respective section and each of said hinges having a pair of aligned portions, said support having an extension between each pair of said aligned portions.

8. The implement of claim 1, wherein said sections have surfaces which are adjacent each other in the collapsed positions of said sections, and further comprising deformable absorbent and/or sweeping cushions affixed to said surfaces.

9. The implement of claim 8, further comprising means for releasably securing said cushions to the respective surfaces.

10. The implement of claim 8, wherein said cushions constitute integral parts of a one-piece pad.

11. The implement of claim 1, wherein said support has a chamber between said hinges, and further comprising a deformable pad secured to said sections, said pad having first and second cushions respectively affixed to said first and second sections and being at least closely adjacent each other and located between said sections in the collapsed positions of said sections, said pad further having a median portion disposed between said cushions and confined in said chamber in the collapsed positions of said sections.

12. The implement of claim 1, further comprising detent means for releasably holding said sections in their extended positions.

13. The implement of claim 12, wherein said support has first surfaces and said sections have second surfaces each abutting a surface of said support in the extended positions of said sections, said surfaces having central portions and said detent means being provided in the regions of central portions of the respective surfaces.

14. The implement of claim 1, further comprising blocking means for preventing stray movements of said support and said first section relative to each other in the extended position of said first section.

15. The implement of claim 14, wherein said blocking means includes means for coupling said support to said first section at least at three spaced-apart locations.

16. The implement of claim 1, wherein said stops are at least substantially confined in the respective recesses in the extended positions of said sections.

* * * * *